US005362523A

United States Patent [19]

Gorynin et al.

[11] Patent Number: 5,362,523

[45] Date of Patent: Nov. 8, 1994

[54] METHOD FOR THE PRODUCTION OF COMPOSITIONALLY GRADED COATINGS BY PLASMA SPRAYING POWDERS

[75] Inventors: Igor V. Gorynin; Boris V. Farmakovsky; Alexander P. Khinsky; Karina V. Kalogina, all of Leningrad, U.S.S.R.; Alfredo V. Riviere, Caracas, Venezuela; Julian Szekely, Weston; Navtej S. Saluja, Cambridge, both of Mass.

[73] Assignee: Technalum Research, Inc., Cambridge, Mass.

[21] Appl. No.: 980,132

[22] Filed: Nov. 23, 1992

Related U.S. Application Data

[63] Continuation of Ser. No. 755,077, Sep. 5, 1991, abandoned.

[51] Int. Cl.[5] ..... C23C 4/12; B05D 1/12

[52] U.S. Cl. ..... 427/446; 427/454; 427/456; 428/610

[58] Field of Search ..... 427/446, 450, 451, 453, 427/454, 455, 456, 190, 191, 404, 405, 419.1, 419.2, 419.3, 419.7; 428/547, 610, 632, 633, 937

[56] References Cited

U.S. PATENT DOCUMENTS

| | | | |
|---|---|---|---|
| 3,620,808 | 11/1971 | Monroe . | |
| 3,719,519 | 3/1973 | Perugini | 427/454 |
| 3,779,720 | 12/1973 | Ellis et al. | 428/937 |
| 3,912,235 | 10/1975 | Janssen . | |
| 3,927,223 | 12/1975 | Takabatake et al. | 427/454 |
| 3,947,269 | 3/1976 | Prasse et al. | 427/223 |
| 4,055,705 | 10/1977 | Stecura et al. | 427/454 |
| 4,060,471 | 11/1977 | Pinch et al. . | |
| 4,101,703 | 7/1978 | Schintlmeister | 428/216 |
| 4,117,514 | 9/1978 | Maslov et al. . | |
| 4,198,442 | 4/1980 | Gupta et al. | 427/405 |
| 4,248,940 | 2/1981 | Goward | 428/633 |
| 4,481,237 | 11/1984 | Bosshart et al. | 428/610 |
| 4,588,607 | 5/1986 | Matarese et al. | 427/455 |
| 4,612,256 | 9/1986 | Neuhäuser et al. | 427/454 |
| 4,723,589 | 2/1988 | Iyer et al. | 427/455 |
| 4,746,534 | 5/1988 | Phillipi et al. | 427/454 |
| 4,778,649 | 10/1988 | Niino et al. | 428/547 |
| 4,806,385 | 2/1989 | Timmons | 427/455 |
| 4,822,689 | 4/1989 | Fukubayashi et al. | 75/252 |
| 4,877,705 | 10/1989 | Polidor . | |
| 4,904,542 | 2/1990 | Mroczkowski | 428/610 |
| 4,950,558 | 8/1990 | Sarin | 428/698 |
| 5,032,469 | 7/1991 | Merz et al. | 427/34 |

FOREIGN PATENT DOCUMENTS

| | | |
|---|---|---|
| 0139396 | 5/1985 | European Pat. Off. . |
| 0183638 | 6/1986 | European Pat. Off. . |
| 02299522 | 7/1987 | European Pat. Off. . |
| 57-71671A | 5/1982 | Japan . |
| 58-15742A | 1/1983 | Japan . |
| 2130250 | 5/1984 | United Kingdom . |

OTHER PUBLICATIONS

"Preferential Sputtering on the Surface of Silver-Palladium Alloys" by Dong et al. *Chemical Abstracts,* 101:214982Z (1984).

"Effects of Carbon Content of Substrate on Transverse-Rupture Strength of Tungsten Carbide-Cobalt Alloy Process by CVD [chemical vapor deposition] Process" by Hayashi et al. *Chemical Abstracts,* 101:214982Z (1984).

"Microprocessor Control of the Spraying of Graded Coatings" by Kaczmarek et al. *Chemical Abstracts,* 101:214984b (1984).

*Primary Examiner*—Terry J. Owens

*Attorney, Agent, or Firm*—Choate, Hall & Stewart

[57] ABSTRACT

The method for preparing a coating with a continuous compositional gradient includes introducing at least first and second powders into a plasma torch at separately controllable variable feed rates for each powder and co-depositing the at least first and second powders on the substrate and adjusting the relative feed rates of the first and second powders such that a smooth continuous compositional grading is achieved in the coating. The compositional gradient can follow a linear, exponential or variable function. A sublayer may be deposited onto the substrate prior to deposition of the compositionally graded layer. Additional materials that impart other desirable properties to the layer can be added with the layer or applied after deposition of the layer. Choice of atmosphere during deposition include vacuum, inert atmosphere, and oxidizing, carburizing and boriding atmospheres.

23 Claims, 2 Drawing Sheets

METHOD FOR THE PRODUCTION OF COMPOSITIONALLY GRADED COATINGS BY PLASMA SPRAYING POWDERS

This is a continuation of copending application(s) Ser. No. 07/755,077 filed on Sep. 5, 1991, now abandoned.

BACKGROUND OF THE INVENTION

The present invention relates to coatings having a continuous compositional gradient and methods for their preparation. The present invention further relates to the formation of stable interfaces between two materials having large differences in their physical properties, specifically, thermal expansion coefficients.

For many applications, i.e., catalysts, wear-resistant and tribological articles, it is necessary to join two materials with very different physical characteristics. This is particularly the case for ceramic-coated metals. The differences in thermal expansion coefficients and ductility makes the materials particularly susceptible to mechanical and thermal shock leading to delamination or spalling of the coating layers.

In an attempt to alleviate this problem, an interlayer with intermediate chemical and physical properties is used. As a further refinement of this process, several layers with varying physical and chemical properties are applied between the substrate and coating.

U.S. Pat. No. 3,620,808 discloses the formation of a thermal emissivity coating on a metallic substrate. To reduce thermal shock and improve handleability, several discrete coatings, each containing successively higher amounts of the emissivity material, are applied onto a nickel-aluminum interlayer. The balance of material in each coating layer is nickel-aluminum. Although the specimen shows improved thermal shock resistance, the composition of the layers are still discontinuous at the interlayer/coating and coating/coating interfaces. This limits their utility with materials of greatly differing thermal expansion values.

It is therefore advantageous to overcome the limitations of the prior art and to provide a method for forming thermally and physically stable interfaces between materials with different physical properties.

SUMMARY OF THE INVENTION

It is the object of the present invention to prepare articles with high mechanical and thermal shock resistance. It is a further object of the present invention to provide a method for preparing coatings with a continuous compositional gradient.

In a preferred embodiment of the present invention, a coating with a continuous compositional gradient is prepared by introducing a first and second powder into a plasma torch at separately controllable variable feed rates for each powder. The two powders are co-deposited onto the metal substrate. The relative feed rates of the first and second powders are adjusted such that a smooth continuous compositional grading is achieved in the coating. The first powder preferably has a composition substantially similar to that of the substrate. Each of the first and second powders can be composed of one or more compounds.

When the powders are reactive in air, i.e., metals, the deposition is carried out under an inert atmosphere. If, however, it is desirable to deposit a metal oxide, then an oxide powder or an oxidizable metal can be deposited in air or oxygen. The metal will oxidize to the corresponding metal oxide. The amount of oxygen can be varied during the course of the deposition to promote a gradient of the oxidized and unoxidized components. Boriding, carburizing and nitriding atmospheres can also be used. Deposition can also be carried out in a vacuum.

In another aspect of the present invention, a sublayer is deposited prior to deposition of the compositionally graded layer. The sublayer should have good adherence to the metal substrate. The sublayer can be applied by conventional physical and chemical deposition methods. The sublayer can be a metal or combination of metals or an intermetallic compound. The first powder preferably has substantially the same composition as the sublayer. The first powder also can contain a precursor capable of being converted into the compound of the second powder under the processing conditions of the plasma deposition. The second powder is any ceramic material such as metal oxides, metal carbides, metal nitrides and metal borides. The first and second powders are introduced into a plasma torch at separably controllable feed rates for each powder. The relative feed rates for both powders are adjusted such that a smooth continuous compositional gradient is achieved in the coating.

In a preferred embodiment, means are provided for feeding an additional one or more powders into said plasma torch during the compositionally graded co-deposition of the first and second powders whereby the additional powders are incorporated into the coating. The additional powders are introduced mixed with either the first or second powders or from a third feeder. The powders can be crystalline or amorphous, they can be filler material or they can impart desirable properties to the layer. They are required only to be nonreactive with respect to the first and second powders and to be stable under the processing conditions of plasma spray deposition.

In a preferred embodiment, the powders can be fed into the cool or hot zones of the plasma torch resulting in powders with different exit velocities from the torch. The density of the resulting layer is in part controlled by the exit velocity of the impinging particles.

Articles prepared according to the present invention are exceptionally stable to mechanical and thermal shock. In addition, the process is highly flexible and can allow for the use of a wide range of starting materials and end uses. For example, it is possible to apply a porous outer surface for increased catalytic activity or, alternately, a tough outer surface for abrasion resistance.

DESCRIPTION OF THE PREFERRED EMBODIMENT

It is known that flame sprayed or plasma sprayed metal or metal oxide powders can be applied in varying thicknesses to a variety of metallic substrates. The flame spraying of these materials includes feeding the powder particles through a high temperature flame of about 3000 ° C. where they are softened and subsequently deposited onto a substrate. This invention uses these known high temperature spraying systems in a deposition process such that the method of depositing these powders imparts highly desirably properties to the final article.

In accordance with this invention, a layer having a smooth continuous compositional gradient is deposited onto a suitable substrate or sublayer. Suitable substrates are ceramic materials or metals such as stainless steel, low alloy steel, TD Nickel® (<0.015% Cu, <0.05% Fe, <0.02% C, bal. Ni) and nickel alloys such as Inconel 600® (0.25% Cu, 8% Fe, 15.5%, Cr, 0.25% Si, 0.5% Mn, 0.08% C, 0.007% S, 76% Ni, Hastelloy® (6% Fe, 17% Cr, 19% Mo, 0.1% Si, 1% Mn, 5% W, 51% Ni) and Haynes 25. Suitable sublayers are preferably metals or intermetallic compounds. Suitable first powders should have substantially the same composition as the substrate or sublayer upon which it is deposited. Suitable second powders can be any metal oxide, metal carbide, metal nitride or metal boride or a precursor therefor, which is converted into the desired material under the deposition conditions.

Figure 1:
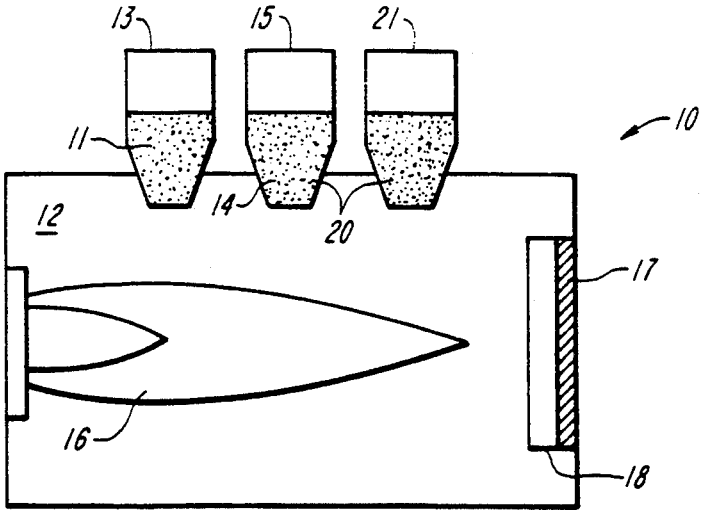
FIG. 1 is a cross-sectional view of the plasma spray apparatus used for deposition of a compositionally graded coating.

Referring to FIG. 1, which illustrates a plasma spray apparatus 10 used for the coating process of the present invention, a first powder 11 is introduced into a deposition chamber 12 from a feeder 13 which is equipped with means of variably controlling the powder feed rate (not shown). A second powder 14 is introduced into the deposition chamber 12 from feeder 15 which is also equipped with means of variably controlling the powder feed rate (not shown). Powders 11 and 14 are directed into a stream 16 of a plasma torch flame where they melt or at least soften. They are then accelerated onto a substrate 17 where they form a compositionally graded coating 18 of the present invention. The compositional gradient of the layer 18 is achieved by varying the relative amounts of powders 11 and 14 from substantially only powder 11 at the substrate interface to substantially only 14 at the outermost surface.

The steepness of the compositional gradient is a function of the difference in the coefficients of thermal expansion for powders 11 and 14. The stress generated by each incremental change in composition must be small enough so that there is no failure during use. If the difference in thermal expansion coefficients is large, the gradient must be small to minimize stress. If the difference in thermal expansion coefficients is small, then the gradient can be steeper with no detrimental affect to the performance of the layer. A linear compositional gradient is most preferred, although gradients that vary exponentially or by any other equation are possible. It is also possible to prepare layers with fluctuating gradients, that is, with the cyclic increasing and decreasing of the first and second powders.

The compositionally graded layers are typically 20–50 μm thick. At thicknesses much greater than 50 μm, the mechanical properties of the coating, such as mechanical shock resistance, degrade.

Figure 2:
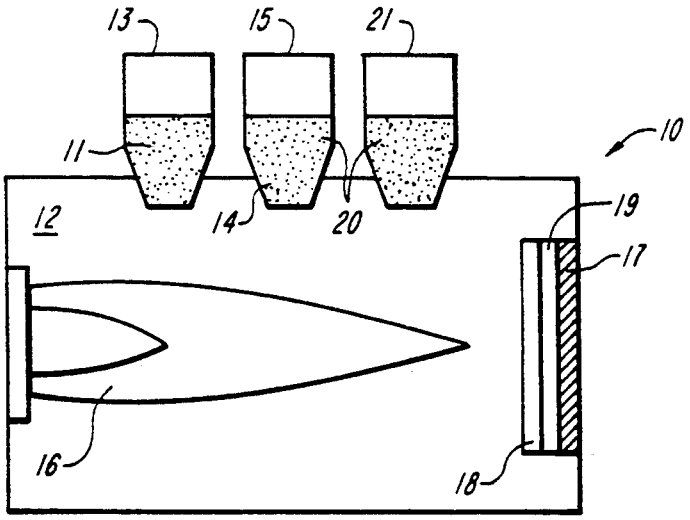
FIG. 2 is a cross-sectional view of the plasma spray apparatus used for deposition of a sublayer and compositionally graded coating.

The deposition of a sublayer 19 can be easily incorporated into the method shown in FIG. 2. Accordingly, first powder 11 is introduced alone into the deposition chamber 12 from feeder 13 which is equipped with means of controlling the powder feed rate. Powder 11 is directed into stream 16 of the plasma torch flame where it melts or at least softens. It is then accelerated onto the substrate 17. After a sufficient thickness (ca. 20 μm) has been deposited, the second feeder 15 is turned on and the process continues as described above, resulting in sublayer 19 interposed between substrate 17 and compositionally graded coating 18.

Figure 3:
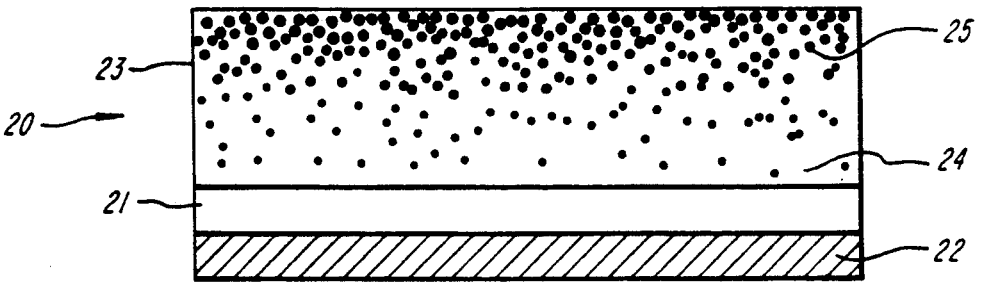
FIG. 3 shows a cross-sectional view of a typical coating obtained from the method of the present invention.
Figure 4:
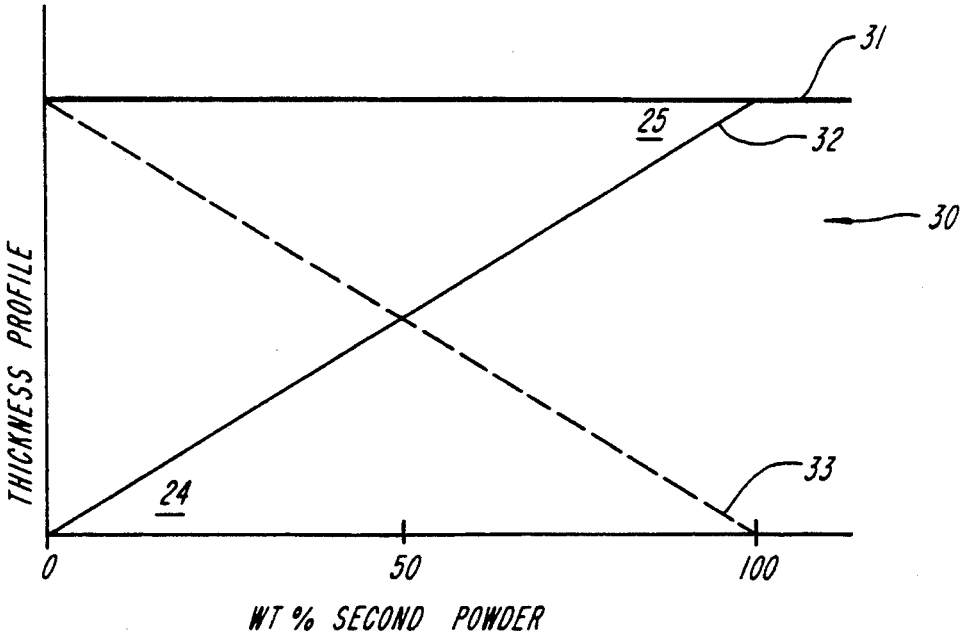
FIG. 4 shows a graph of thickness profile v. composition.

FIG. 3 shows a typical coated article 20 prepared according to the method of the invention. An optional sublayer 21 is deposited on a substrate 22. A compositionally graded coating 23 is then deposited as described above to give a region 24 that has a composition substantially similar to that of the substrate or sublayer and has a smooth continuous gradient to the outermost region 25 that has a composition substantially similar to that of the second powder. FIG. 4 is a graph 30 showing the composition of layer 23 across the thickness profile. A horizontal line 31 designates the outermost surface of layer 23. A curve 32 shows a linear change in composition of the second powder from near 0 wt % second powder near the region 24 to near 100 wt % second powder near the region 25. A second curve 33 shows the composition of the first powder in regions 24 and 25.

It is also possible to incorporate additional powders 20 into the compositionally graded layer. Referring to FIGS. 1 and 2, these powders can be added directly to the second powder or can be added in a third feeder 21. Additional powders are added to impart desirable properties to the graded coating. They can be catalysts (various metal oxides) or stabilizers or abrasion resistant materials (refractory metal carbides and nitrides).

An important role of the additional powders is to control porosity in the graded layer. Such porosity producing powders are metal carbonates or hydroxides that give off gas or vapor during decomposition. By releasing $CO_2$ or $H_2O$ at the surface, pores and cavities are formed with diameter of 0.5–5.0 μm. In an ideal situation, the metal carbonate decomposes to a metal oxide whose presence is desired in the layer because it serves a secondary purpose, thereby avoiding contamination of the layer with undesirable decomposition products.

The plasma flame is not of one uniform temperature. If powders are fed into the hot zone near the center of the flame, they will exit the flame with a higher velocity than powders fed into the cooler zones of the flame. When particles impinge the substrate at higher velocities, the porosity of the resulting layer is reduced. The same effect can be achieved by varying the power to the flame.

The second powder need not be in its end use form. It can be a precursor which, when heated in a reactive atmosphere in the deposition chamber, reacts to form the desired final product. For example, if one wanted to deposit aluminum oxide, fine aluminum powder is introduced into the chamber in an oxygen or air atmosphere. Metal nitrides could be formed by introducing a reactive form of the metal into an ammonia-containing atmosphere.

The following examples illustrate the versatility, utility and superior properties of articles prepared according to the method of the present invention.

EXAMPLE 1

Example 1 describes a method for preparing an article with a compositional gradient and a highly porous surface.

A sublayer was applied to a substrate of heat resistant steel alloy containing 15% Cr and 5% Al 50 μm in thickness and 100 mm in width. Argon was used as the plasma forming gas with a plasma escape rate of 800±50 m/s. A Ni-Al composite powder (80% Ni/20% Al; 20–50 μm) was plasma sprayed to deposit the adhesive layer. The thickness of the applied adhesive layer was at least 20 μm.

The compositionally graded coating was produced using a Ni-Al composite powder and γ-aluminum oxide as the first and second powders, respectively. The powders were fed into the plasma flame using simultaneously operating feeders having self-contained gears. Air was used as the plasma-forming gas, which has a plasma escape rate less than 500 m/s (optimum 450±50 m/s). One feeder supplied the $\gamma$-$Al_2O_3$ powder with a particle size of less than 10 μm (preferably 3–8 μm) and the other supplied the composite powder with a particle size less than 80 μm (preferably 40–50 μm).

The thickness of the applied layer was not greater 30 μm (preferably 20–25 μm). As the thickness of the layer increased, the amount of $\gamma$-$Al_2O_3$ powder was increased linearly in the range of 0 to 100 wt % and the amount of composite Ni-Al powder supplied by other feeder was linearly reduced. Then, the feeder containing the Ni-Al composite powder was turned off and the spraying of γ-aluminum oxide powder in combination with manganese carbonate powder (particle size <10 μm) began. Manganese carbonate was introduced from a third feeder. The powder ratio of $\gamma$-$Al_2O_3$ to $MnCO_3$ ranged from (1.5–2.0) to 1. Heating $MnCO_3$ at 620° C. lead to its decomposition to MnO and $CO_2$. The escaping $CO_2$ gas resulted in pore formation and the surface had a surface area of 50 $m^2/g$ using pycnometry.

EXAMPLE 2

Example 2 describes a method for preparing an article with a compositional gradient suitable for use as a thermal emissivity coating.

A coating was prepared on a steel alloy substrate containing 15% Cr and 5% Al 100 mm wide and 50 μm thick. An adhesive layer 40 ±5 μm thick was deposited on the substrate using a high velocity argon plasma spray. The adhesive layer contained 80 wt % nickel and 20 wt % aluminum.

A compositionally graded coating of Ni-Al composite powder and $ZrO_2$ (25 ±5 μm) was subsequently deposited onto the sublayer. The coating was produced using a Ni-Al composite powder and zirconium oxide as the first and second powders, respectively. The powders were fed into the plasma flame using simultaneously operating feeders having self-contained gears. Air is used as the plasma-forming gas, which had a plasma escape rate less than 500 m/s (optimum 450±50 m/s). One feeder supplied the $ZrO_2$ powder and the other supplied the composite powder. As the thickness of the layer increased, the amount of $ZrO_2$ increased linearly from 0 to 100 wt % and the amount of NiAl powder decreased correspondingly so that the powder volume remained constant.

The phase composition of the compositionally graded coating was Ni, $Ni_3Al$, $\gamma$-$Al_2O_3$ and $ZrO_2$. $Al_2O_3$ was obtained from the oxidation of aluminum in the Ni-Al powders. The specific surface area of the outer layer containing $ZrO_2$ and $\gamma$-$Al_2O_3$ was 52 ±5 $m^2/g$. The adhesive strength of the article was determined qualitatively by the bending test method. The multilayer structure was not destroyed after bending around a cylinder of 1.2 mm.

EXAMPLE 3

Example 3 describes a method for preparing an article with a compositionally graded layer containing a tough refractory metal nitride outer layer for wear-resistance.

A suitable substrate is that of Example 1, 15Cr-5Al steel. The coating is produced using a Ni powder and titanium dioxide as the first and second powders, respectively. Nickel is chosen for the first powder because of the similarity of its thermal expansion coefficient with that of the substrate and because it adheres well to the substrate. The powders are fed into the plasma flame using simultaneously operating feeders having self-contained gears. Air is used as the plasma-forming gas. The deposition chamber additionally contains 1–4 bar pressure of ammonia. As the thickness of the layer increased, the amount of $TiO_2$ powder is increased linearly in the range 0–100wt % and the amount of composite Ni-Al powder supplied by other feeder is linearly reduced. In the presence of ammonia, titanium is deposited as titanium nitride on the substrate. Then, the feeder with the Ni-Al composite powder was turned off and the spraying of titanium dioxide powder alone begins. Thus a tough layer of TiN is deposited on the surface of the compositionally graded layer.

What is claimed is:

1. A method for the production of a coating with a compositional gradient, comprising the steps of:
   - introducing a powder into a plasma torch, said powder comprising a first component of said coating and said powder capable of conversion into a second component of said coating;
   - applying said powder from said plasma torch onto a substrate under reaction conditions sufficient to convert a portion of said powder into said second component, whereby a mixture of said first component and said second component results; and
   - adjusting said reaction conditions during application of said powder from said plasma torch onto said substrate such that an increasing proportion of said powder is converted to said second component as application progresses and a compositionally graded coating is obtained.

2. The method of claim 1, wherein said powder has substantially the same composition as said substrate.

3. A method for the production of a coating with a compositional gradient, comprising the steps of:
   - introducing a first powder and a second powder into a plasma torch, said first powder comprising a first component of said coating and said second powder being capable of being oxidized into a second component of said coating;
   - controlling the relative rate of introduction of said first and second powders into said plasma torch; and
   - applying said first and second powders from said plasma torch onto a substrate under oxidizing reaction conditions sufficient to convert a portion of said second powder into said oxidized second component, such that a compositional gradient of said first component and said oxidized second component is obtained.

4. The method of claim 3, wherein said first powder has substantially the same composition as said substrate.

5. The method of claim 3, wherein the step of applying said powders under oxidizing conditions comprises applying said powders in an oxidizing atmosphere selected from the group consisting of air and oxygen.

6. A method for the production of a coating with a compositional gradient, comprising the steps of:

introducing a first powder and a second powder into a plasma torch, said first powder comprising a first component of said coating and said second powder being capable of conversion into a second component of said coating;

controlling the relative rate of introduction of said first and second powders into said plasma torch; and adjusting said reaction conditions during application of said first and second powders from said plasma torch onto said substrate such that an increasing proportion of said second powder is converted to said second component as application progresses and a compositionally graded coating is obtained.

7. The method of claim 1 or 6, wherein the step of adjusting said reaction conditions comprises adjusting a content of a reactive gas present during application of said coating.

8. The method of claim 7, wherein the content of said reactive gas is adjusted during application of said coating.

9. The method of claim 7, wherein the content of said reactive gas is increased during application of said coating.

10. The method of claim 7, wherein said reactive gas is selected from the group consisting of oxygen and ammonia.

11. The method of claim 1 or 6, wherein the step of adjusting said reaction conditions comprises adjusting the temperature of said plasma torch during application of said coating.

12. The method of claim 1 or 6, wherein the step of adjusting said reaction conditions comprises adjusting the temperature of said substrate during application of said coating.

13. The method of claim 1, 3 or 6, wherein the step of applying powder onto said substrate is carried out in an atmosphere comprising oxygen.

14. The method of claim 1, or 6, wherein the step of applying powder onto said substrate is carried out in a nitriding atmosphere.

15. The method of claim 1 or 6, wherein the step of applying powder onto said substrate is carried out in a carburizing atmosphere.

16. The method of claim 1 or 6, wherein the step of applying powder onto said substrate is carried out in a boriding atmosphere.

17. The method of claim 1, 3 or 6, further comprising the step of:

introducing an additional one or more powders into said plasma torch during the application of said powders whereby said additional powders are incorporated into said coating.

18. The method of claim 1, 3 or 6, further comprising the steps of:

introducing an additional one or more powders into said plasma torch after the application of said powders whereby said additional powders are deposited on said coating.

19. The method of claim 1, 3 or 6, further comprising the step of:

applying a sublayer onto said substrate prior to the application of said compositionally graded coating thereon.

20. The method of claim 1 or 6, wherein the step of adjusting said reaction conditions comprises adjusting said reaction conditions so as to obtain a compositional gradient which follows an exponential function.

21. The method of claim 1 or 6, wherein the step of adjusting said reaction conditions comprises adjusting said reaction conditions so as to obtain a compositional gradient which follows a linear function.

22. The method of claim 3 or 6, wherein the step of controlling the relative rate of powder introduction comprises controlling said powder introduction so as to obtain a compositional gradient which follows a linear function.

23. The method of claim 3 or 6, wherein the step of controlling the relative rate of powder introduction comprises controlling said powder introduction so as to obtain a compositional gradient which follows an exponential function.

* * * * *

UNITED STATES PATENT AND TRADEMARK OFFICE

CERTIFICATE OF CORRECTION

PATENT NO. : 5,362,523

DATED : November 8, 1994

INVENTOR(S) : Igor V. Gorynin et al.

It is certified that error appears in the above-identified patent and that said Letters Patent is hereby corrected as shown below:

On the title page, item [76], delete "Alfredo V. Riviere and insert - - Alfredo Riviere, V - - .

Column 3, line 22, after "Ni" please insert-- ), and
Column 3, line 58, delete "affect" and insert therefor - - effect- -.

Signed and Sealed this

Seventeenth Day of October, 1995

Bruce Lehman

*Attest:*

BRUCE LEHMAN

*Attesting Officer*

*Commissioner of Patents and Trademarks*